United States Patent [19]

Kamio et al.

[11] Patent Number: 4,666,667

[45] Date of Patent: May 19, 1987

[54] HIGH-STRENGTH, HIGH-CONDUCTIVITY COPPER ALLOY

[75] Inventors: Morinori Kamio; Masahiro Tsuji; Hirohito Miyashita, all of Samukawa, Japan

[73] Assignee: Nippon Mining Co., Ltd., Tokyo, Japan

[21] Appl. No.: 844,237

[22] Filed: Mar. 25, 1986

Related U.S. Application Data

[63] Continuation of Ser. No. 695,154, Jan. 25, 1985, abandoned.

[30] Foreign Application Priority Data

May 22, 1984 [JP] Japan ..... 59-101723

[51] Int. Cl.[4] ..... C22C 9/02

[52] U.S. Cl. ..... 420/471; 420/472; 420/473; 420/475; 420/494

[58] Field of Search ..... 420/471–476, 420/492, 494, 495, 496, 500; 148/412, 433, 435

[56] References Cited

U.S. PATENT DOCUMENTS 4,486,250 12/1984 Nakajima ..... 420/472

FOREIGN PATENT DOCUMENTS

| | | | |
|---|---|---|---|
| 115935 | 9/1980 | Japan | 420/472 |
| 5836 | 1/1982 | Japan | 420/473 |
| 39145 | 3/1982 | Japan | 420/492 |
| 169047 | 10/1982 | Japan | 420/472 |
| 39142 | 2/1983 | Japan | 420/473 |
| 59850 | 4/1984 | Japan | 420/472 |
| 112813 | 1/1985 | Japan . | |
| 146882 | 2/1985 | Japan . | |

OTHER PUBLICATIONS

Copper Development Association, Inc., Greenich Office Park 2, Box 1840, Greenwich, CT 06836–1840, "Application Data Sheet".

*Primary Examiner*—Christopher W. Brody

*Attorney, Agent, or Firm*—Seidel, Gonda, Goldhammer & Abbott

[57] ABSTRACT

A high-strength, high-conductivity copper alloy comprises, all by weight, from 0.8 to 4.0% of Sn, from more than 0.01 to 0.4% of P, from 0.05 to 1.0% of Ni, from 0.05 to 1.0% of one, two or more elements selected from Al, Hf, Be, Mo, Zn, Te, Pb, Co, Zr, and Nb, and the remainder of Cu and inevitable impurities. The impurities include not more than 0.0020% of oxygen.

6 Claims, No Drawings

HIGH-STRENGTH, HIGH-CONDUCTIVITY COPPER ALLOY

This is a continuation of co-pending application Ser. No. 695,154 filed on Jan. 25, 1985, now abandoned.

BACKGROUND OF THE INVENTION

This invention relates to a copper alloy suited as material for leads of semiconductor devices such as transistors and integrated circuits (ICs) and also as material for electrically conductive springs for connectors, terminals, relays, switches and the like.

As materials for leads of semiconductor devices, high nickel alloys such as Kovar (Fe-29Ni-16Co) and 42 alloy (Fe-42Ni) have been used by preference because of their low thermal expansion coefficients and abilities to bond and seal elements and ceramics. In recent years, more and more large-power-consuming ICs have come into use with increases in the integration degree of semiconductor circuitry. Also, resins are in wider use than before as sealing material, and improvement have been made in techniques for bonding elements and lead frames. Accordingly, copper-base alloys having higher thermal conductivity are favored today over the nickel alloys as lead materials for leads.

Generally, a material for forming leads of semiconductor devices is required to have the following properties:

(1) Excellent thermal and electric conductivities, because leads must function as parts for transmitting electric signals and also function to release to the outside the heat generated during the packaging process and while the circuit is in use.

(2) A thermal expansion coefficient close to that of the mold material so as to ensure good adhesion of the leads to the mold which is important from the viewpoint of semiconductor element protection.

(3) Sufficient thermal resistance to withstand various heating steps involved in the packaging.

(4) Good machinability since most leads are made by stamping or bending the material.

(5) High plate adhesion which facilitates precious metal plating of the lead surface.

(6) Good solderability because the lead portions exposed from the sealing material after packaging, known as outer leads, are often soldered subsequently.

(7) Adequate corrosion resistance for the sake of reliability and life of the devices with the leads.

(8) Low cost.

The whole set of these property requirements have not been met by any single one of existing alloys that have merits and demerits, such as oxygen-free copper, tin copper, iron copper, phosphor bronze, Kovar, and 42 alloy.

For the fabrication of springs for electric devices and apparatuses and also for instruments, switches, connectors and so forth have been employed inexpensive brass, nickel silver having outstanding spring properties and corrosion resistance, and phosphor bronze with prominent spring properties. However, brass has poor strength and spring properties. Nickel silver and phosphor bronze do possess excellent strength and spring properties, but they are expensive alloys due partly to the material cost since they contain 18% by weight nickel and 8% tin, respectively, and partly to working limitations including poor hot machinability. They exhibit an additional disadvantage of low electric conductivities when used in electric equipment and the like. Introduction of low-cost alloys with excellent spring properties has, therefore, been eagerly waited in the art.

BRIEF SUMMARY OF THE INVENTION

The present invention has been perfected with the foregoing in view. It is aimed at remedying the shortcomings of the conventional copper-base alloys and providing a copper alloy having properties suitable as a material for leads of semiconductor devices and for electrically conductive springs.

The invention thus provides a high-strength, high-conductivity copper alloy comprising from 0.8 to 4.0% by weight of tin, from more than 0.01 to 0.4% by weight of phosphorus, from 0.05 to 1.0% by weight of nickel, from 0.05 to 1.0% by weight of one, two or more selected from aluminum, hafnium, beryllium, molybdenum, zinc, tellurium, lead, cobalt, zirconium, and niobium, and the remainder of copper and inevitable impurities, said impurities including not more than 0.0020% by weight of oxygen. The copper alloy according to the invention is characterized by excellent electric and thermal conductivities, heat resistance, machinability, plate adhesion, solderability, corrosion resistance, and other desirable properties as a material for leads of semiconductor devices, combined with prominently high strength, superior spring properties and electric conductivity as a conductive spring material.

DETAILED DESCRIPTION OF THE INVENTION

The reasons for which the proportions of the alloying elements constituting the alloy of the invention are limited to the specified ranges will now be explained. The tin content is confined within the range from 0.8 to 4.0% by weight, because less than 0.8% by weight of tin does not confer desired strength on the resulting alloy despite the addition of phosphorus, whereas more than 4.0% by weight of the element lowers the conductivity and raises the cost. The phosphorus content is specified to range from above 0.01 to 0.4% by weight because 0.01% or less phosphorus does not markedly improve the strength and heat resistance while more than 0.4% of the element causes a sharp decrease in conductivity irrespective of the tin content. A nickel content below the specified range from 0.05 to 1.0% by weight does not contribute strength as expected whereas nickel in excess of the range reduces the conductivity seriously. One, two or more auxiliary ingredients chosen from among aluminum, hafnium, beryllium, molybdenum, sinc, tellurium, lead, cobalt, zirconium, and niobium improves the strength and spring properties but if the amount or combined amount is less than 0.5% the favorable effects are not appreciable. If the amount exceeds 1.0% a sharp drop of conductivity results. Hence the range from 0.05 to 1.0% by weight. The oxygen content is restricted to at most 0.0020% by weight because more oxygen will reduce the plate adhesion of the resulting alloy. Among the auxiliary ingredients, zinc in a specified amount imparts the resistance to the phenomenon that the solder is peeled off after some heat hystrisis. To optimize this property the zinc content desirably is confined within the range from 0.2 to 1.0% by weight.

The alloy of the foregoing composition according to the invention possesses excellent strength, spring properties, heat resistance, and electric conductivity. In addition, it has good solderability and plate adhesion. With a thermal expansion coefficient close to those of plastics, the alloy forms leads of semiconductor devices suited for plastic packaging. Thus, the alloy of the invention is most satisfactory as a material for the leads of semiconductor devices and for electrically conductive springs. None of the prior art alloys have combined these general properties of materials for such different applications.

The material according to the present invention is illustrated by the following examples.

EXAMPLES

Ingots of alloy compositions according to the invention based on electrolytic or oxygen-free copper and containing various ingredients in the proportions shown in Table 1 were made by melting each composition in air or in an inert or reducing atmosphere by a high-frequency melting furnace and then casting the melt. Each ingot was rolled hot at 800° C. into a plate 4 mm thick. The plate was face grinded and cold rolled into a 1.0 mm-thick sheet. After annealing at 500° C. for one hour, the sheet was further cold rolled into a sheet 0.8 mm thick. The product was tested for evaluation as a material for leads. For the evaluation purposes, the strength and elongation of each test material were indicated by the results of tensile tests, the heat resistance by the softening temperature on 5 minutes' heating, and the electric conductivity (heat resistance) by the conductivity (in %IACS). The solderability was determined by the vertical dipping method, i.e. by dipping the test piece vertically in a plating bath (60% tin and 40% lead) at 230° C.±5° C. for 5 seconds and visually observing the degree of wetting with the solder. The plate adhesion was estimated by depositing a 3 μ-thick silver plate on the test piece, heating the plated piece at 450° C. for 5 minutes, and then visually inspecting the plated piece for any blister on the surface. The results are given together with those of reference alloys in Table 1.

For the evaluation also as spring materials, 1.0-mm thick sheets of the same alloys as used above were annealed at 500° C. for one hour, cold rolled into thinner sheets of 0.5 mm thickness, and were annealed for stress relieving at varied temperatures ranging from 150° to 500° C. The strength and elongation of the test pieces thus obtained were estimated by tensile tests and the springness by the Kb value. The results plus conductivity test results are given in Table 2 along with the corresponding data of reference alloys. The solderability and plate adhesion values were little different from those of the lead materials and are omitted from the table, partly for want of space. Further, the alloy compositions of the invention containing varied proportions of zinc were tested for their solderability with thermal exfoliation resistance. The results are compared with those of reference alloys in Table 3. The table indicates that the alloy compositions of the invention having zinc contents between 0.2 and 1.0% by weight give good results in this respect.

From Tables 1 to 3 it is evident that the alloy according to the present invention has excellent properties as a high-strength, high-conductivity copper alloy.

TABLE 1

| | Alloy composition (wt %) | | | | | | Conductivity | Tensile strength | Elongation | Softening point | Solderability | Plate adhesion (blistered |
|---|---|---|---|---|---|---|---|---|---|---|---|---|
| | Cu | Sn | P | Ni | Others | Oxygen | (% IACS) | (Kg/mm²) | (%) | (°C.) | | or not) |
| Alloys of the invention | | | | | | | | | | | | |
| (1) | bal. | 1.0 | 0.03 | 0.2 | 0.2 Al | 0.0010 | 36 | 45.2 | 14 | 460 | Good | No |
| (2) | " | 2.0 | 0.05 | 0.2 | 0.1 Hf, 0.1 Be | 0.0008 | 29 | 50.1 | 16 | 460 | " | " |
| (3) | " | 2.0 | 0.04 | 0.3 | 0.2 Zn, 0.1 Pb | 0.0010 | 23 | 48.3 | 11 | 480 | " | " |
| (4) | " | 2.5 | 0.03 | 0.4 | 0.1 Al, 0.2 Be | 0.0006 | 22 | 52.6 | 14 | 455 | " | " |
| (5) | " | 2.5 | 0.06 | 0.5 | 0.1 Te | 0.0009 | 22 | 50.7 | 14 | 460 | " | " |
| (6) | " | 3.5 | 0.05 | 0.3 | 0.2 Co | 0.0007 | 24 | 53.2 | 13 | 480 | " | " |
| (7) | " | 3.5 | 0.04 | 0.4 | 0.1 Zr | 0.0004 | 23 | 51.2 | 11 | 475 | " | " |
| (8) | " | 3.7 | 0.10 | 0.2 | 0.3 Hf | 0.0011 | 21 | 48.9 | 13 | 455 | " | " |
| (9) | " | 3.5 | 0.06 | 0.7 | 0.2 Nb | 0.0010 | 20 | 48.7 | 12 | 460 | " | " |
| (10) | " | 3.0 | 0.04 | 0.5 | 0.3 Al, 0.1 Zn | 0.0006 | 24 | 50.9 | 14 | 460 | " | " |
| (11) | " | 3.0 | 0.03 | 0.4 | 0.1 Al, 0.1 Be 0.1 Zn | 0.0005 | 21 | 53.4 | 11 | 475 | " | " |
| (12) | " | 2.0 | 0.04 | 0.2 | 0.5 Zn | 0.0007 | 24 | 49.2 | 12 | 475 | " | " |
| Reference alloys | | | | | | | | | | | | |
| (1) | " | 0.6 | 0.02 | 0.1 | — | 0.0032 | 50 | 39.7 | 14 | 430 | " | Yes |
| (2) | " | 2.0 | 0.10 | 0.2 | 1.2 Al | 0.0010 | 14 | 47.8 | 10 | 455 | Poor | No |
| (3) | " | 4.5 | 0.15 | 0.3 | 1.5 Al, 0.3 Hf | 0.0006 | 9 | 55.5 | 12 | 460 | " | " |
| (4) | | | | | Cu - 2.3 Fe - 0.1 P | | 60 | 39.1 | 8 | 450 | Good | Yes |
| (5) | | | | | Fe - 42 Ni | | 5 | 58.7 | 15 | 550 | Poor | No |

TABLE 2

| | Alloy composition (wt %) | | | | | | Conductivity | Tensile strength | Elongation | Kb value |
|---|---|---|---|---|---|---|---|---|---|---|
| | Cu | Sn | P | Ni | Others | Oxygen | (% IACS) | (Kg/mm²) | (%) | (Kg/mm²) |
| Alloys of the invention | | | | | | | | | | |
| (1) | bal. | 1.0 | 0.03 | 0.2 | 0.2 Al | 0.0010 | 36 | 53.3 | 9 | 44 |
| (2) | " | 2.0 | 0.05 | 0.2 | 0.1 Hf, 0.1 Be | 0.0008 | 29 | 59.5 | 9 | 49 |
| (3) | " | 2.0 | 0.04 | 0.3 | 0.2 Zn, 0.1 Pb | 0.0010 | 23 | 59.0 | 8 | 47 |
| (4) | " | 2.5 | 0.03 | 0.4 | 0.1 Al, 0.2 Be | 0.0006 | 22 | 60.7 | 10 | 52 |
| (5) | " | 2.5 | 0.06 | 0.5 | 0.1 Te | 0.0009 | 22 | 55.4 | 12 | 45 |
| (6) | " | 3.5 | 0.05 | 0.3 | 0.2 Co | 0.0007 | 24 | 61.0 | 11 | 53 |

TABLE 2-continued

| | Alloy composition (wt %) | | | | | | Conductivity (% IACS) | Tensile strength (Kg/mm²) | Elongation (%) | Kb value (Kg/mm²) |
|---|---|---|---|---|---|---|---|---|---|---|
| | Cu | Sn | P | Ni | Others | Oxygen | | | | |
| (7) | " | 3.5 | 0.04 | 0.4 | 0.1 Zr | 0.0004 | 23 | 57.3 | 8 | 45 |
| (8) | " | 3.7 | 0.10 | 0.2 | 0.3 Hf | 0.0011 | 21 | 54.2 | 10 | 45 |
| (9) | " | 3.5 | 0.06 | 0.7 | 0.2 Nb | 0.0010 | 20 | 53.8 | 11 | 44 |
| (10) | " | 3.0 | 0.04 | 0.5 | 0.3 Al, 0.1 Zn | 0.0006 | 24 | 56.0 | 12 | 48 |
| (11) | " | 3.0 | 0.03 | 0.4 | 0.1 Al, 0.1 Be, 0.1 Zn | 0.0005 | 21 | 59.0 | 9 | 50 |
| (12) | " | 2.0 | 0.04 | 0.2 | 0.5 Zn | 0.0007 | 24 | 60.5 | 8 | 50 |
| Reference alloys | | | | | | | | | | |
| (1) | " | 0.6 | 0.02 | 0.1 | — | 0.0032 | 50 | 45.2 | 10 | 31 |
| (2) | " | 2.0 | 0.10 | 0.2 | 1.2 Al | 0.0010 | 14 | 59.3 | 7 | 48 |
| (3) | Cu - 35 Zn | | | | | | 25 | 54.2 | 10 | 32 |
| (4) | Cu - 8 Sn - 0.15 P | | | | | | 12 | 74.8 | 14 | 63 |
| (5) | Cu - 26 Zn - 18 Ni | | | | | | 6 | 72.0 | 8 | 59 |

TABLE 3

| | Alloy composition (wt %) | | | | | | Thermal exfoliation of solder |
|---|---|---|---|---|---|---|---|
| | Cu | Sn | P | Ni | Others | Oxygen | |
| Alloys of the invention | | | | | | | |
| (1) | bal. | 1.0 | 0.03 | 0.2 | 0.15 Zn | 0.0012 | Slight |
| (2) | " | 2.0 | 0.03 | 0.2 | 0.3 Zn | 0.0007 | No |
| (3) | " | 3.5 | 0.04 | 0.3 | 0.8 Zn | 0.0006 | " |
| Reference alloys | | | | | | | |
| (1) | " | 2.0 | 0.03 | 0.2 | — | 0.0015 | Yes |
| (2) | " | 8.0 | 0.15 | — | — | 0.0009 | " |
| (3) | Cu - 2.3 Fe - 0.1 P | | | | | | " |

Treating conditions:
The same test pieces as used in evaluating the solubility were tested. After air annealing at 150° C. for 500 hours, each test piece was bent to 90° back and forth, and then was visually inspected for any exfoliation of the solder.

What is claimed is:

1. A high-strength, high-conductivity phosphor bronze alloy having enhanced resistance to peeling of solder at an elevated temperature consisting essentially of:

from 0.8 to 4.0% by weight of tin;

from 0.01 to 0.4% by weight of phosphorus; from 0.05 to 1.0% by weight of nickel;

from 0.05 to 1.0% by weight of zinc; and the remainder of copper and inevitable impurities.

2. A high-strength, high-conductivity phosphor bronze alloy having enhanced resistance to peeling of solder at an elevated temperature consisting essentially of:

from 0.8 to 4.0% by weight of tin;

from 0.01 to 0.4% by weight of phosphorus;

from 0.05 to 1.0% by weight of nickel;

from 0.05 to 1.0% by weight of zinc;

from 0.05 to 1.0% by weight of one or more elements selected from the group consisting of aluminum, beryllium and lead; and the remainder of copper and inevitable impurities.

3. The alloy of claim 1 wherein the zinc is in the range of 0.2 to 1.0% by weight.

4. The alloy of claim 2 wherein the zinc is in the range of 0.2 to 1.0% by weight.

5. The alloy of claim 1 wherein said impurities include not more than 0.0020% by weight of oxygen.

6. The alloy of claim 2 wherein said impurities include not more than 0.0020% by weight of oxygen.

* * * * *